US005086839A

United States Patent [19]

Setterberg, Jr. et al.

[11] Patent Number: 5,086,839

[45] Date of Patent: Feb. 11, 1992

[54] WELL PACKER

[75] Inventors: John R. Setterberg, Jr., Dallas; Pat M. White, Carrollton, both of Tex.

[73] Assignee: Otis Engineering Corporation, Dallas, Tex.

[21] Appl. No.: 611,188

[22] Filed: Nov. 8, 1990

[51] Int. Cl.[5] ..... E21B 33/128; E21B 33/129

[52] U.S. Cl. ..... 166/138; 166/216

[58] Field of Search ..... 166/134, 138, 139, 140, 166/216, 387

[56] References Cited

U.S. PATENT DOCUMENTS

| | | | |
|---|---|---|---|
| 2,720,267 | 10/1955 | Brown | 166/138 X |
| 2,720,924 | 10/1955 | Brown | 166/138 |
| 2,795,281 | 6/1957 | Christian | 166/138 X |
| 3,279,542 | 10/1966 | Brown | 166/216 X |
| 3,467,184 | 9/1969 | Young | 166/138 X |
| 4,018,274 | 4/1977 | Cochran | 166/138 X |
| 4,524,825 | 6/1985 | Fore | 166/139 |
| 4,671,354 | 6/1987 | Henderson et al. | 166/134 |
| 4,844,154 | 7/1989 | Ross et al. | 166/139 |

FOREIGN PATENT DOCUMENTS

| | | | |
|---|---|---|---|
| 681782 | 10/1952 | United Kingdom | 166/140 |

*Primary Examiner*—William P. Neuder
*Attorney, Agent, or Firm*—Johnson & Gibbs

[57] ABSTRACT

A well packer for sealing an annular space within a well bore around a tubing string including a tubular mandrel, an expandable seal assembly on the mandrel for sealing around the mandrel with a well bore wall, a slip assembly on the mandrel for releasably locking the packer with the well bore wall, a drag spring and slip carrier assembly around the slip assembly, and an interlock assembly for selectively coupling the drag spring and slip carrier assembly with the mandrel for operating the packer through running, set, and release modes. The interlock assembly includes running segments movable a limited distance on the mandrel to prevent jamming of the packer parts in response to mandrel rotation in a non-setting direction. The interlock assembly also includes locking segments having structure to fully seat the segments on the mandrel under load and to minimize packer element compression loss during setting. The packer has an emergency release feature for releasing the packer in the event that well obstructions or other problems prevent normal rotation of the tubing string and mandrel to operate the interlock assembly.

19 Claims, 3 Drawing Sheets

WELL PACKER

BACKGROUND OF THE INVENTION

1. Field of the Invention

This invention relates to improvements in well packers which may be set and reset without retrieval to the surface in various well applications such as injection, production, and disposal wells.

More particularly, this invention relates to improvements in a Well Packer illustrated in U.S. Pat. No. 4,844,154, issued to Colby M. Ross and Pat M. White, July 4, 1989, assigned to Otis Engineering Corporation.

2. History of the Prior Art

It is well known in the well art, and particularly in the oil and gas industry, to use well packers in the bore of a well around the well tubing to seal the annulus between the well tubing and the well bore wall for isolating one or more vertical portions of the well bore. Well packers are used in testing, treating, and producing wells and in disposal well applications. These various and diverse systems employing well packers involve a wide range of depths at which the packers are used, environments which may produce extremes of high temperature and pressure as well as corrosive fluids, brine solutions, water, steam, and other natural formation fluids and fluids used in treating and producing wells. These various applications require a maximum of pressure sealing and corrosion resistance when left in place over long periods of time. In addition to the need for functioning in extreme hostile environments, the high cost of running, setting, and pulling packers in wells which requires handling equipment at the surface, as well as substantial periods of shut-down time, make it highly desirable to use packers capable of release and reset within a well bore without removal. It is particularly desirable for such a packer to be simple in construction with a minimum number of parts utilizing such features as one-piece locking slips, wherein one end of such slips is set initially before fully expanding the annular seal assembly prior to setting the slips to achieve maximum leak-free seals. Well packers capable of performing these desired functions, particularly for service under the adverse conditions described, require very high quality expensive materials which make such packers quite costly to manufacture. Thus, it is also desirable to reduce the physical size, particularly the length, of such special application packers to minimize the use of the necessary expensive materials, thereby reducing the cost of the packers. A well packer which has achieved these objectives is shown in FIGS. 1-7 of the above mentioned U.S. Pat. No. 4,844,154. Under certain operating conditions difficulties have developed which affect packer setting when torque opposite to normal setting procedure torque is applied during running the packer. Further, some loading conditions may affect complete locking segment seating and cause some reduction in packer element loading.

SUMMARY OF THE INVENTION

It is a particularly important object of the invention to provide a new and improved well packer.

It is another object of the invention to provide a new and improved well packer useful under a variety of well applications and adverse conditions, such as found in some injection, production, and disposal wells.

It is another object of the invention to provide a well packer having an interlocking assembly operable in a running mode, a set mode, and a release mode permitting the packer to be set and released in a well, run to another location, and reset in the well without retrieval to the surface.

It is another object of the invention to provide a well packer in which the interlock assembly is combined with the packer slip assembly to drastically reduce the length of the packer.

It is another object of the invention to provide a short, compact, corrosion-resistant packer that can be set at any depth in a well bore.

It is another object of the invention to provide a well packer having one-piece slips wherein one end of the slips is initially set and the packer elements are partially expanded prior to the setting of the other ends of the slips and the full expansion of the slips and packer elements.

It is another object of the invention to provide a well packer which may be set and held in tension in a neutral condition or in compression.

It is another object of the invention to provide a packer which can be set and reset while retaining maximum capability of withstanding pressures and without removal from the well bore.

It is another object of the invention to provide a well packer which may be released under emergency conditions by application of a straight or longitudinal force if the tubing string cannot be rotated.

It is another object of the invention to provide a well packer which withstands pressure from either direction across the packer.

It is another object of the invention to provide a well packer in which the slip and slip carrier structure is combined with the drag spring assembly for reduction of the length of the packer.

It is another object of the invention to provide a well packer which includes new and improved slip springs reducing the manufacturing time and expense required in prior coil spring operated packer slips.

It is another object of the invention to provide a well packer which includes an interlock assembly having running elements and a mandrel provided with interconnection thread configurations which limit upward movement of the running segments on the mandrel to prevent jamming of the packer setting structure which may interfere with setting of the packer.

It is another object of the invention to provide a well packer having an interlock assembly which includes locking segments and related apparatus for maintaining the locking segments in full engagement with the locking threads on the mandrel to reduce premature locking segment failure and to minimize the loss of packer element compression during the setting procedure.

In accordance with the invention, there is provided a well packer having a tubular body mandrel with a longitudinal central flow passage, an annular packer element assembly on the body mandrel expandable to seal an annular space between body mandrel and a well bore wall surface, a drag spring and locking slip assembly on the mandrel for releasably locking the packer along a well bore, and an interlock assembly associated with the slip and drag spring assembly for selectively coupling the drag spring and slip assembly with the body mandrel for setting and releasing the packer responsive to longitudinal and rotational motion of the body mandrel. The interlock assembly includes running segment and mandrel features which disengage the running segments from the mandrel when the mandrel is rotated opposite to the normal setting procedure rotation to prevent jamming which may prevent proper setting. The interlock assembly also includes locking segments and related structure for maintaining the locking segments fully seated during setting procedure to minimize locking segment damage and reduction of packer seal element loading.

BRIEF DESCRIPTION OF THE DRAWING

The foregoing objects and advantages of the invention together with the specific details of a preferred embodiment will be better understood from the following detailed description taken in conjunction with the accompanying drawings wherein.

DETAILED DESCRIPTION OF THE PREFERRED EMBODIMENT

Figure 1:
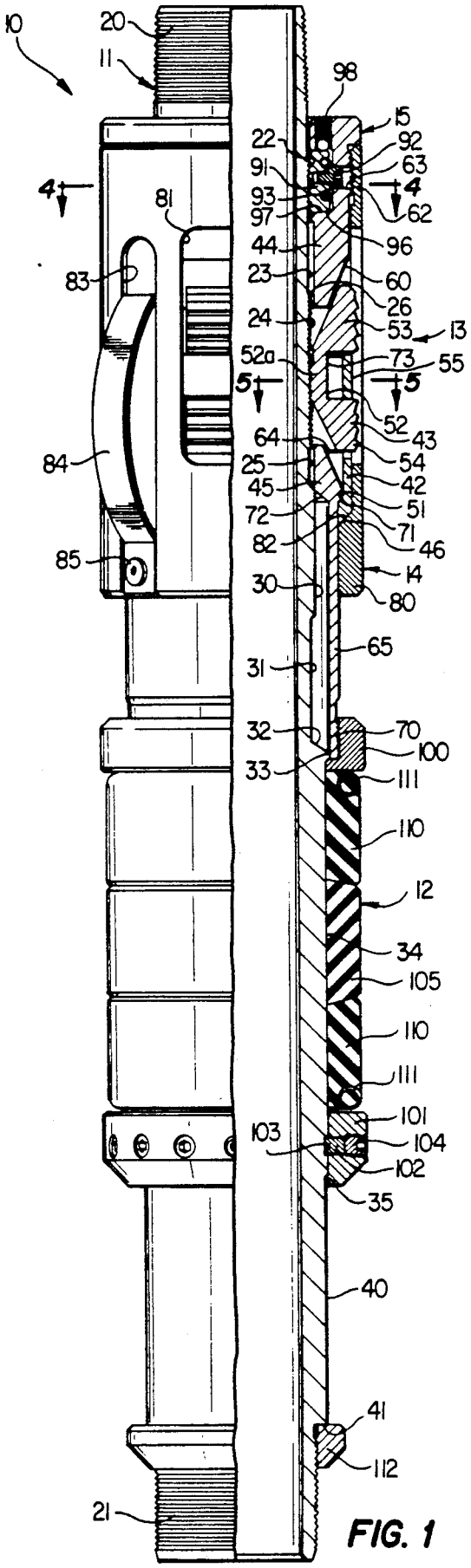
FIG. 1 is a longitudinal view in section and elevation of the well packer in a running mode.
Figure 4:
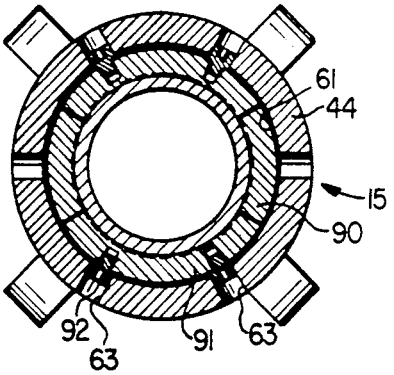
FIG. 4 is a view in section along the line 4—4 of FIG. 1, showing, in particular, the running and locking segments of the interlock assembly.
Figure 5:
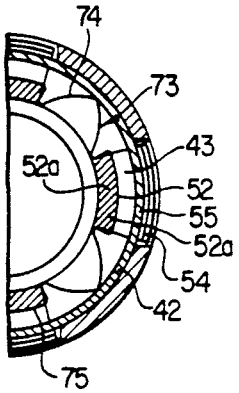
FIG. 5 is a fragmentary view in section along the line 5—5 of FIG. 1.

Referring to FIGS. 1, 4, and 5, a well packer 10 embodying the features of the invention includes a tubular mandrel 11, a packer element assembly 12, a locking slip assembly 13 in a drag spring and slip carrier assembly 14, and an interlock assembly 15 within the slip assembly and drag spring assembly for selective coupling with the mandrel in the various operating modes of the packer. The packer may be run into a well bore, set, released, reset, and retrieved by a series of manipulations involving a sequence of steps of raising, lowering, and turning the tubing string and mandrel. The interaction between the slip assembly, the drag spring assembly 14, and the interlock assembly with the mandrel 11 provides the necessary slip expanding and retracting functions for setting and releasing the packer in a well bore.

Referring to FIG. 1, the mandrel 11 is threaded at 20 along an upper end portion and at 21 along a lower end portion. The external configuration of the mandrel 11 includes a section 22 of left-hand running threads, a slightly reduced, outer, smooth-wall section 23, a section 24 comprising right-hand locking threads, an external annular recess 25 below the threads 24, a slightly enlarged wall section 30, a reduced diameter portion 31, an upwardly facing downwardly tapered stop shoulder 32 at the lower end of the section 30, a stop flange 33 below the shoulder 32, a smooth outer wall section 34 for the packer element assembly, an external downwardly facing stop shoulder 35 at the lower end of the section 34, and an outer wall portion 40 of slightly reduced diameter below the section 34 terminating in a downwardly facing annular stop shoulder 41. As discussed in more detail hereinafter, the thread section 22 is limited in length to minimize jamming during setting due to inadvertent rotation in the wrong direction as the packer is run.

Figure 7:
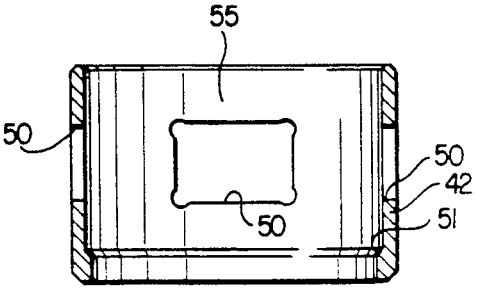
FIG. 7 is a view in section and elevation of the slip housing of the packer.

The slip assembly 13 includes a slip housing 42 shown in detail in FIG. 7, a plurality of slips 43, an upper wedge and interlock assembly retainer ring 44, and a lower wedge 45. As best seen in FIG. 7, the slip housing has circumferentially spaced rectangular slip windows 50, each sized and shaped to permit the expansion and retraction of a slip 43 while holding the slip on the mandrel as evident in FIG. 1. The internal diameter of the lower end portion of the housing 42 is reduced to provide an upwardly facing operating shoulder 51 which cooperates with an operating shoulder, described hereinafter, on the wedge 45 during the operation of the slip assembly. Each of the slips 43 is an arcuate shaped member slightly narrower than the arcuate length of the window 50 in the housing 42. A central lateral recess 52 extends across the slip dividing the slip into an upper externally toothed portion 53 and a lower toothed portion 54. The housing 42 has a lateral retainer portion 55 which is an integral part of the body of the housing above each of the windows 50, as seen in FIG. 7, which holds each of the slips disposed in each of the windows. As evident in FIG. 1, the retainer portion 55 fits within the slip recess 52 so that as each slip expands and retracts the upper portion 53 of the slip is above the upper end edge of the slip housing 42 while the lower portion 54 of the slip moves in and out in the slip window 50, the housing retainer portion 55 serving as a guide and keeping the slip from falling out of the slip assembly. The upper wedge and interlock assembly retainer ring 44 has a downwardly and inwardly sloping slip expander surface 60 for engaging and expanding the upper ends of the slips 43 and an internal annular recess 61 which contains the interlock assembly 15, as shown in more detail in FIG. 4. The member 44 is secured by external threads 62 in the upper end of the drag spring housing 14. The member 44 has a plurality of circumferentially spaced, radial holes 63 for retainer screws which couple the interlock assembly 15 with the member 44 as seen in FIG. 4. The lower slip expander wedge 45 has an upwardly and inwardly sloping expander surface 64 and a tubular body 65 externally threaded along a lower end portion 70 which is secured in the upper retainer ring of the packer element assembly 12, as described hereinafter. The wedge 45 has an external annular operating shoulder 71 and an internal stop flange 72.

The slips 43 are biased inwardly within the housing 42 around the mandrel i by four formed springs 73 arranged in annular, end-to-end array around the mandrel within the slip housing 42, FIG. 5, to aid in holding the slips 43 properly positioned around the mandrel and to bias the slip inwardly toward the mandrel. Each of the springs 73 has straight opposite end sections which bend when stressed to resemble one half of a parabola and a central integral section 75 which is sized and shaped as a circular segment to fit around and hold the central portion 52*a* of the slip. Each spring 73 encompasses 90 degrees of the annular space around the mandrel within the slip housing 42 in which the slips are installed. The use of the formed springs 73 substantially reduces the cost of the slip assembly in comparison with coil springs as illustrated in U.S. Pat. No. 4,671,354, because the slip machining required for the coil springs is substantially more expensive than that required for the central portion 52*a* of the slips in the present invention to accommodate the slips to the formed springs.

The drag spring and slip carrier assembly 14 includes a tubular slip carrier 80 internally threaded as previously described, along an upper end portion secured to the upper wedge and interlock assembly ring 45. The slip carrier has circumferentially spaced slip windows 81, sized and shaped to permit expansion and contraction of the slips and longitudinal motion of the slips and the slip housing 42 necessary for setting and releasing the packer in a well bore. The lower end portion of the slip carrier 80 has a reduced diameter bore sized to fit in sliding relation around the bottom wedge housing 65 and provided with a downwardly and inwardly sloping stop shoulder 82 engageable by the tapered lower end 46 of the slip housing 42 limiting the relative downward movement of the slip housing and slips within the slip carrier. The outer wall of the slip carrier 80 is provided with circumferentially spaced downwardly opening drag spring recesses 83. An outwardly bowed multilayered drag spring 84 is secured along a lower end portion in each of the recesses 83 by a retainer screw 85. Only the lower end portion of the drag spring is secured to the slip carrier so that each drag spring may spread and extend longitudinally within the recess 83 as it is compressed inwardly moving along a well bore. The drag springs are designed when compressed radially to engage a well bore wall sufficiently to provide enough friction resisting movement of the slip carrier 80 to permit the necessary slip and interlock assembly functions for locking and releasing the packer.

Figure 6:
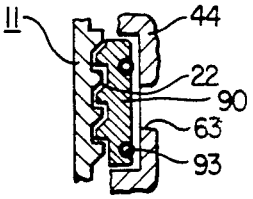
FIG. 6 is a schematic fragmentary view in section of a portion of the tubular body mandrel and one of the segments of the interlock assembly showing the thread configuration employed on the mandrel and in the segments of the interlock assembly.

The interlock assembly 15 provides the necessary coupling between the mandrel 11 and the slip assembly 13 for locking and releasing the packer. The interlock assembly, as shown in FIGS. 1 and 4, is mounted within the top wedge and ring 44 in the recess 61 around the mandrel 11. The interlock assembly includes internally threaded arcuate running segments 90 and arcurate lock segments 91 arranged in annular, end-to-end array around the mandrel within the ring 44, FIG. 4. Each of the segments extends approximately 15 degrees around the annular space between the mandrel and the retainer ring. The two running segments 90 are spaced 180 degrees apart between two pairs of the locking segments arranged end-to-end along opposite sides, 180 degrees apart. The locking segments 91 are each loosely held in position by a socket head screw 92. The shank of each of the screws 92 is threaded into a locking segment 91 and the head of the screw fits loosely within a bore 63 of the member 44 so that the locking segments can move radially but cannot travel circumferentially around the annular space between the mandrel 11 in the member 44. The running segments 90 are captured between the locking segments. A pair of garter springs 93 are arranged around the assembly of running and locking segments as seen in both FIGS. 1 and 6, passing laterally across the segments in the semi-circular recesses provided in the outer surface of each of the segments. The garter springs hold the segments 90 and 91 snugly around the mandrel against the thread section 22 on the mandrel in the running mode of FIG. 1. The running segments 90 have internal left-hand thread sections extending the circumferential length of the segments shaped and sized to coact with the left-hand threads 22 on the mandrel. FIG. 6 shows in enlarged fragmentary form the thread configuration and the relationships between the mandrel threads and the running slip threads. The threads are a buttress type thread having one face perpendicular to the longitudinal axis of the mandrel 11 and the other face tapered with respect to such longitudinal axis. As shown in FIG. 6, the mandrel threads have a perpendicular upper face and a tapered lower face. To conform to the left-hand mandrel threads 22 the thread sections within the running segments 90 have perpendicular lower faces and tapered upper faces. This relationship permits a racheting action between the running segments 90 and the mandrel when the mandrel is urged downwardly relative to the running segments.

Figure 8:
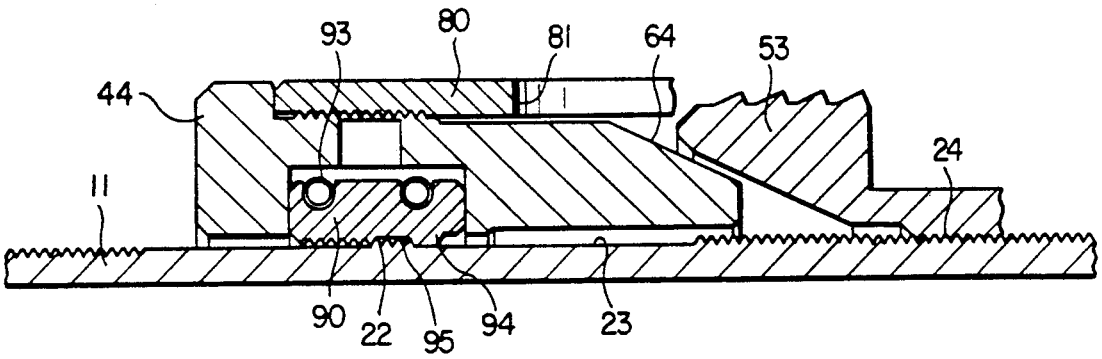
FIG. 8 is an enlarged fragmentary view in section of the interlock assembly showing the running segments disengaged from the mandrel running threads after mandrel rotation opposite to normal setting rotation.
Figure 9:
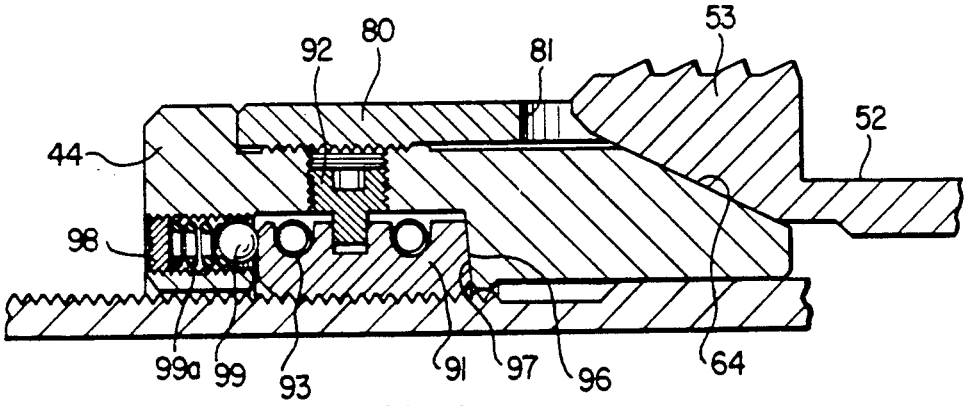
FIG. 9 is an enlarged fragmentary view in section showing the locking segments of the interlock assembly and structure for holding the segments in full contact with the mandrel looking threads.

In accordance with the invention, as shown in FIG. 8, the external mandrel running thread section 22 is very short in 0 10 length, being approximately one-half ($\frac{1}{2}$) the length of the internal surface of the running segments 90 which are engageable with the mandrel surface and thread section 22. The internal left-hand thread section of the running segments 90 is also of limited length, being approximately one-third ($\frac{1}{3}$) the length of the internal surface of the segments 90 engageable with the mandrel surface and thread section 22. The internal left-hand threads in the running segments extend from the upper end of the segment toward the segment center. The running segments are each provided with an internal stop flange 94 spaced from the segment threads along the lower end portion of the segments. Between the threads in the segment and the stop flange 94 each segment has an internal release recess 95 which is longer than the mandrel thread section 22 so that when the running segments move upwardly on the mandrel in response to left-hand rotation of the mandrel, the segments stop in the positions illustrated in FIG. 8 at which positions the mandrel thread section 22 is within the running elements recesses 95. At this position, continued left-hand rotation of the mandrel will not cause the running segments to move any farther upwardly on the mandrel. The thread section 22 is disengaged from the internal threads of the running segments and upward movement of the segments is limited by the stop flanges 94. Thus, the mandrel may freely rotate in a left-hand direction with the running segments remaining at the release positions illustrated in FIG. 8.

The thread sections in the locking segments 91 and the mandrel threads 24 are right-hand threads of the same buttress design with the thread orientation and relationship between the mandrel threads and the locking segment threads being the reverse of that shown in FIG. 6. Stated otherwise the threads 24 on the mandrel have downwardly sloping upper faces and perpendicular lower faces. The thread sections within the locking segments 91 have perpendicular upper faces and sloping lower faces. Thus, the looking segments will freely move down or rachet down on the mandrel threads 24 as there is little resistance to the downward movement of the locking segments. The perpendicular faces of the threads 24 and in the locking segments 91 prevent the locking segments from moving upwardly on the mandrel threads, however. It will be recognized that with the use of both right and left hand threads on both the mandrel and within the running and locking segments that the right-hand threaded parts will not fit the left-hand threaded part. Thus, when the interlock assembly is at the running position, as in FIG. 1, the right-hand thread sections in the locking elements 91 will not mesh with the left threads 22 on the mandrel; and thus the locking slips threads extend across the left hand threads, and the locking slips simply slide along the outer face of the mandrel threads. Similarly, when the interlock assembly is at the lower position on the mandrel threads 24, the right-hand threads on the mandrel will mesh in the locking elements 91 while the left hand threads of the running elements 90 will not mesh, and thus, the running elements will simply slide along the outer surface of the threads 24. The radial depth of the recess 61 in the retainer ring 44 is sufficient that the running segments and the looking segments may move radially outwardly against the garter springs sufficiently for the non-meshing segments to slide along the nonmeshing mandrel threads. The radial depth of the recess 61 is not, however, any deeper than necessary to allow the locking segments to move outwardly sufficiently to ratchet downwardly along the right-hand locking threads on the mandrel. Further, in accordance with the invention and as illustrated in FIGS. 1 and 4, the interlock assembly is designed to maintain maximum engagement of the locking segments with the locking threads on the mandrel. The design of the locking segments, the retainer ring 44, and related structure is to prevent, to the maximum extent possible, radial misalignment of the locking segments under load which tends to cause the lower ends of the segments to flair outwardly disengaging the lower locking segment threads from the mandrel threads thereby placing the full load on the upper locking segment threads which remain engaged with the mandrel locking threads. To maintain this maximum engagement of the locking segments with the mandrel threads, the lower end edge surfaces 96 of the locking segments are tapered upwardly providing an angled bearing shoulder on the lower ends of each of the locking segments. The bearing shoulder is engageable with a correspondingly angled lower end surface 97 or bearing shoulder of the recess 61 in the retainer ring 44. The bearing shoulders 96 on the locking segments and 97 in the retainer ring have been found to effectively function at a 5 degree slope which cams the lower end portions of the locking segments inwardly to aid in maintaining maximum thread contact. Additionally, to urge the locking segments inwardly, the retainer ring is provided with ball plunger set screw assemblies 98 mounted along axes which run parallel with the longitudinal axis of the packer mandrel and are positioned in the retainer ring at the circumferential center line of each of the locking segments. The four ball plunger set screws are circumferentially spaced at the same positions around the retainer ring 44 as the set screws 92 which loosely couple the locking segments with the retainer ring. Each of the ball plunger set screw assemblies includes a ball 99 and a spring 99*a* which urges the ball toward the upper end edge of the locking element. A spring biased ball 99 engages the upper end surface of each locking element radially outwardly from the centroid of the locking element providing a moment arm or bending moment on the locking element coacting with the camming action on the lower end of the locking element to urge the lower end portion of the locking element inwardly for full engagement of the looking element threads with the locking threads on the mandrel. The particular ball plunger set screw assemblies employed used balls which were spring loaded to provide approximately 20 pounds of downward force against each of the locking segments providing both the bending moment on the segments and urging the segment downwardly against the bearing shoulder 97 of the retainer ring recess. This looking element arrangement not only urges the looking elements against the locking threads on the mandrel, but also minimizes slack in the packer setting apparatus so that loss of element compression is minimize as the packer is set.

The packer element assembly 12 is mounted on the mandrel long the mandrel section 34 below the flange 33 between a top element retainer ring 100 and a bottom element retainer ring 101. The retainer ring 100 threads on the lower end of the housing section 65 of the lower wedge 45. The inner diameter of the ring 100 forms a sliding fit with the mandrel section 34 below the flange 33 so that the mandrel may move up for compressing the packer element assembly. The lower retainer ring 101 is held on the mandrel engaged with the stop shoulder 35 by shear pins 102 which extend into an external annular shear pin recess 103 on the mandrel. The shear pins are held in place in the ring 101 by socket head screws 104. The seal element assembly 12 includes a central element 105 and upper and lower elements 110 each of which has an embedded spring 111 to aid in resisting extrusion of the packer element material when expanded in sealed relationship against a casing wall. The seal elements are of an elastomeric construction which may include a combination of suitable metallic and non-metallic materials capable of withstanding high pressures as well as corrosive fluids, such as $CO_2$ and $H_2S$. A catcher ring 112 is threaded on the lower end of the mandrel 111 against the stop shoulder 41 for retaining the seal element assembly and other components of the packer on the mandrel under circumstances where the packer must be pulled by shearing the pins 102 as explained hereinafter.

OPERATION

When the well packer 10 of the invention is to be run and set in a well bore, the packer is connected on at the lower end of a tubing string, not shown, or as an integral part of the tubing string, with sections of tubing above and below the packer. Connections with the upper and lower ends of the packer are made with the threaded mandrel end portions 20 and 21 at the upper and lower ends, respectively, of the packer. The packer is lowered on the tubing string in the running mode illustrated in FIG. 1. In this mode the interlock assembly 15 is engaged with the mandrel threads 22. The threads of the running segments 90 engage the mandrel threads 22 holding the upper wedge 44 at the upper end position illustrated so that the upper wedge and lower wedge 45 do not engage the slips 54 and the springs 73 hold the slips at the inward retracted positions shown. The locking elements 91 of the interlock assembly are riding on the running threads because they are right-hand thread portions and the threads 22 are left-hand threads. As the packer is lowered in the well bore the drag springs 84 drag along the well bore wall opposing the downward movement of the packer, and thus, effectively applying a relative upward force to the slip carrier 14. Since the running segments 90 are engaged with the threads 22 on the mandrel, the interlock assembly prevents any movement of the slip carrier relative to the mandrel so that the slip carrier and drag springs move with the mandrel down the well bore. As the well packer is lowered on the tubing string in a well bore, if left-hand torque is applied to the tubing string rotating the tubing string counterclockwise, the springs 84 dragging along the casing wall tend to hold the packer against rotation allowing the packer mandrel to turn within the interlock assembly 15 causing the running segments to travel upwardly on the running threads 22. The running segments will move upwardly on the mandrel until the threads in the running segment run off the threads 22 on the mandrel so that the mandrel threads are in the recess 95 in the running segments and the segments are released to rotate on the mandrel. The stop flange 94 in each of the segments is below the mandrel threads 22 while the segment threads are above the mandrel threads 22. Any further left-hand rotation of the tubing string does not raise the running segments any farther up the mandrel. The slack in the packer parts is not all taken up and the packer setting apparatus does not jam as a consequence of the left-hand torque applied to the tubing string. At the desired depth in the well bore, the tubing is picked up raising the mandrel 11 with the drag springs 84 resisting upward movement. The tubing and mandrel 11 are rotated clockwise as the mandrel is lifted. Turning of the mandrel clockwise rotates the left-hand threads on the mandrel. The mandrel threads reengage the running segment threads which drives the left-hand threaded running segments 90 downward relative to the mandrel until the running segments move below and are disengaged from the threads 22 and aligned with the unthreaded smooth mandrel section 23 below the threads 22. During this rotating of the mandrel, unless the mandrel is lifted, the angle of the threads on the mandrel and within the running segments would simply cause the segments to rachet over the mandrel threads without rotating off of the left-hand threads 22 of the mandrel. With the lifting of the mandrel, however, the racheting does not occur and the running segments do move relative to the mandrel to the smooth wall section of the mandrel. This, of course, releases the interlock assembly along with the slip carrier 80 and slip assembly 13 from the mandrel. If the mandrel were only rotated without lifting, and since the running segments are coupled with the slip carrier and drag springs, the drag springs would resist the downward movement of the segments and because of the thread angles the running segments would simply move out and over the mandrel threads racheting from one thread to the next thread and not moving off of the threaded section. By lifting the mandrel while rotating this does not occur. As soon as the running segments 90 move below the mandrel threads 22 to the smooth mandrel section 23, the mandrel is uncoupled from the drag spring assembly 14 and the slip assembly 13 so that the mandrel may move up relative to such assemblies. Continued upward movement of the mandrel lifts the bottom ring 101, the seal element 12, the top ring 100, and the wedge housing 65 with the bottom slip wedge 45, while the drag springs 84 resist upward movement of the drag spring assembly including the slip carrier 80, the slip housing 42, and the slips 43. The bottom wedge 45 is raised under the lower ends of the slips 43 forcing the slips outwardly with the teeth on the slips engaging the wall of the well bore. Continued lifting of the mandrel then compresses the packer elements of the assembly 12 as the bottom ring 101 is lifted and the mandrel flange 33 moves upwardly within the top packer element retainer ring 100 bringing the bottom ring 101 closer to the top ring 100 so that the packer elements are compressed longitudinally and expand radially. During this upward movement of the packer mandrel, while the interlock assembly is restrained from upward movement by the drag springs, the mandrel locking threads 24 move into the interlock assembly with the locking segments 9 racheting along the threads 24; and since the threads 24 are right-hand threads and the threads in the elements 91 are right-hand threads, when the threads are in proper alignment the garter springs 93 around the elements will force the elements 91 inwardly so that the element threads engage the mandrel threads 24. During the setting procedure and after the packer is set the ball plunger set screw assemblies 98 and the retainer ring and locking element bearing shoulders 97 and 96 cooperate to urge the locking elements 91 against the mandrel for full engagement of the locking element threads with the mandrel locking threads. During the setting procedure the camming action of the bearing shoulders urges the lower end portions of the locking segments inwardwardly and the bending moment action on the locking segments caused by the spring loaded balls 99 also urges the locking segments against the bearing shoulders as well as tending to rotate the segments so that the threads along the lower inside portions of the segments fully engage the mandrel locking threads 24. During setting this eliminates slack between the locking segments and the retainer ring so that compression loss in the packer element is minimized as the packer is fully set. The interlock assembly is now connected with the mandrel through the locking elements 91 and the mandrel is lowered by the tubing string forcing the top wedge 44 downwardly under the upper ends of the slips 43. The lower faces of the mandrel threads 24 are perpendicular to the mandrel so that during this downward force on the mandrel and the looking slips 91, which also have perpendicular thread portions engaging the perpendicular thread portions on the mandrel, the wedge 44 is forced downwardly. The weight of the tubing string on the mandrel together with any downward force applied to the tubing string applied through the locking elements 91 to the top wedge 44 and the drag spring assembly overcomes the friction of the drag springs and forces the wedge 44 under the upper ends of the slips 43. Since the slips are mounted in the slip housing 42 in the slip carrier 80 around the housing and the slip housing is movable relative to the slip carrier, the wedge, along with the slip carrier and the drag springs, may move downwardly relative to the slips. During this downward movement to drive the upper wedge 44 under the upper ends of the slips, the slips are maintained engaged by the compressed packer element assembly 12 which acts as a spring keeping the lower wedge 45 engaged with lower ends of the slips 43. During the downward movement of the mandrel for setting the upper wedge 44, it will be recognized that there will be some downward movement of the lower element retainer ring 101 which will tend to allow the packer element assembly 12 to somewhat relax, and thus, some of the set in the element assembly is lost during the setting of the upper wedge. The spring effect of the elements during the setting of the upper wedge has functioned to maintain the lower wedge in position. It is now necessary to again pick up on the tubing string pulling the mandrel back upwardly to restore the full expansion or set in the packer element assembly 172. As the mandrel is pulled upwardly, the mandrel threads 24 move within the interlock assembly with the locking elements 91 racheting outwardly, as previously described, until the upward movement of the mandrel stops at which time the elements 91 will engage the threads 24. The mandrel is pulled upwardly forcing the bottom packer element retainer ring 101 upwardly relative the top retainer ring 100 which is held against upward movement by the wedge housing 65 and the integral wedge 45 under the lower ends of the slips 43. The mandrel moves relative to the housing 65 and the ring 100 as the bottom ring 10 compresses and expands the packer element assembly 12. An upward force is applied to the mandrel to an approximate predetermined value, which, for example, may be 30,000 pounds to fully compress and expand the packer element assembly 12. The inner threaded portions of the locking slips 91 are urged by the garter springs 93 into engagement with the mandrel threads 24 restraining the locking slips from downward movement on the mandrel holding the mandrel at the upper position at which the packer element assembly 12 is fully expanded and the slips 43 are fully set. In this set mode, the tubing string, not shown, may then be held in a neutral condition under which there is no downward or upwardward force on the mandrel, or the tubing string may be set in compression or tension as the slips will hold the packer against either upward or downward movement in the casing. With the packer fully set, well conditions may be such that a higher pressure is in the well above the packer element 12 and the packer may be set in compression with the weight of the tubing string bearing down on the packer mandrel. Both downward forces tend to urge the lower end portions of the locking segments radially outwardly which is opposed by the camming action of the bearing shoulders 96 and 97 between the retainer ring 44 and the locking segments 91 as well as the bending moment forces supplied by the ball plunger set screw assemblies 98, in accordance with the invention. These forces maintain full engagement of the locking segments under downward load so that any damage to the looking segments due to less than all of the threads engaging the mandrel threads is minimized if not eliminated.

Figure 2:
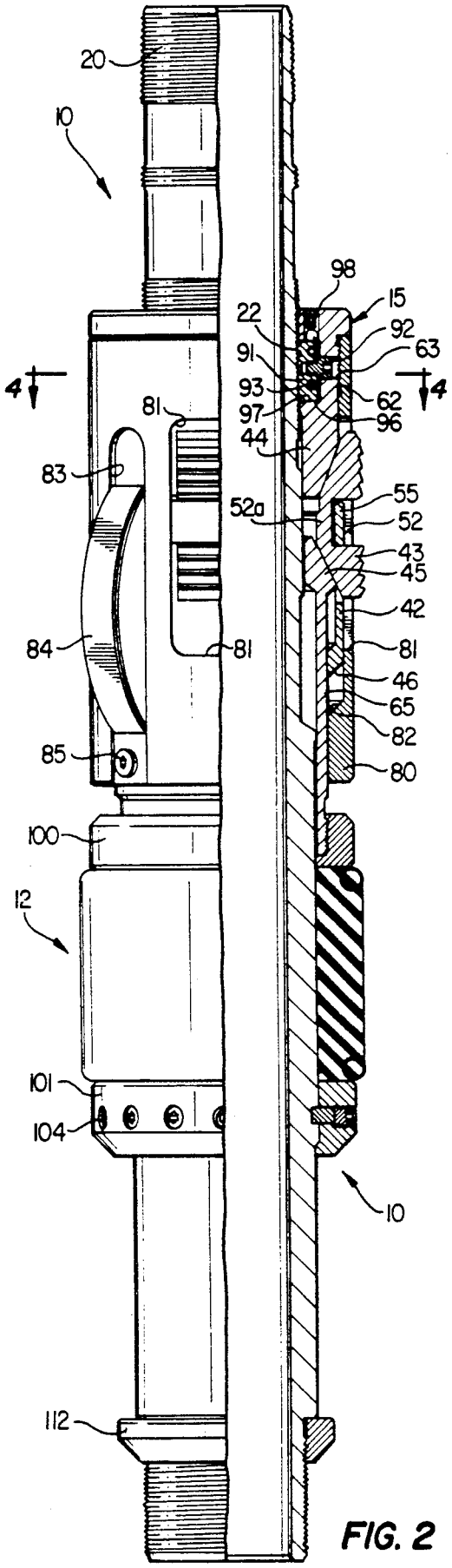
FIG. 2 is a longitudinal view in section and elevation of the well packer of FIG. 1 in a set mode.

FIG. 2 illustrates the packer in the set mode. The slip housing 42 along with the slips 43 is at an upper position relative to the slip carrier 80 at which the lower end surface 46 of the slip housing is spaced above the tapered shoulder 82 in the slip carrier. The length of the windows 81 in the slip carrier readily permits the slips to be disposed at this upper position in the slip carrier. During the final setting sequence of the packer, the slip carrier has moved downwardly relative to the slips in accordance with a novel feature of the invention. It will be noted, also, that the top retainer ring 100 along with the lower end of the bottom wedge housing 65 are spaced below the lower end of the slip carrier 80. The upper threads 22 on the mandrel are above the drag spring and slip carrier assembly. The packer will remain set as long as the desired well production and/or well treating processes are carried out in the well bore. The packer element assembly 12 seals off the annulus in the well casing around the mandrel so that well fluids passing up the well bore must pass through the bore of the mandrel.

In accordance with the invention, the packer may be released and reset in the well bore or pulled from the well bore with the tubing string. The first step in releasing the packer is the lowering of the tubing string putting a downward force on the mandrel while simultaneously the mandrel is rotated to the right, or clockwise as seen from above, turning the right-hand threads 24 within the right-hand thread portions of the locking segments 91. The segments 91 are backed off the lower threads 24 of the mandrel. Since the running segments 90 have internal left-hand threaded portions, the segments 90 ride on the outer surfaces of the mandrel threads 24. When the interlock assembly is aligned with the mandrel section 23, the mandrel is released from the drag spring and slip carrier assembly 14. The tubing string and mandrel is then further lowered so that the mandrel moves downwardly within the drag spring and slip carrier assembly, the lower wedge 45 and wedge housing 65, the upper retainer ring 100, and the expanded packer element assembly 12. The bottom retainer ring 100, is moving downwardly with the mandrel releasing the compression in the packer element assembly. When the mandrel flange 33 reaches the top retainer ring 100 the retainer ring is picked up pulling the bottom wedge housing 65 and the bottom wedge 45 downwardly from under the lower ends of the slips 43. The shoulder 71 on the wedge 45 engages the shoulder 51 within the slip housing 42 pulling the slips 43 downwardly off of the upper wedge 44. This occurs because the drag springs 84 hold the slip carrier 80 against downward movement, and, in accordance with the invention, the slip housing 42 moves longitudinally within the slip carrier 80 permitting the slips 43 to be pulled downwardly relative to the slip carrier. As the mandrel moves downwardly pulling the slips 43 from the top wedge 44, the running segments 90 rachet along the threads 22 on the mandrel, the drag springs 84 holding the drag spring and slip carrier assembly 14 against downward movement, and the locking segments 91 sliding along the threads 22 because the looking segments have internal right hand threads and the threads 22 are left hand threads. When the interlock assembly 15 including the running segments 90 moves onto the mandrel threads 22, the packer is fully released and returned to the running mode illustrated in FIGS. 1A and 1B.

The released packer may be pulled from the well bore or may be moved to an another location in the well and reset in accordance with the previously described procedure for initially setting the packer. When the bottom wedge 45 is pulled from beneath the slips 43, and the slips are pulled off the top wedge, the springs 73 retract the slips inwardly around the mandrel. The engagement of the interlock assembly with the mandrel threads 22 keeps the packer in the running mode for pulling or resetting.

When relocating the packer along a well bore, if the tubing string and mandrel are lifted upwardly, the interlock assembly 15 holds the upper wedge 44 above the slips 43 while the bottom wedge 45 is kept at a position spaced below the lower ends of the slips 43 by the flange 33 on the mandrel. If the tubing string and mandrel are lowered, the engagement of the mandrel flange 33 with the ring 100 of the packer element assembly connected with the wedge housing 65 keeps the bottom wedge 45 from moving upwardly under the slips 43 while the top wedge 44 is held as previously described at a position spaced above the upper ends of the slips 43 by the interlock assembly engaged on the mandrel threads 22. Thus, the packer may be moved either upwardly or downwardly without re-engaging the slip wedges with the slips so that the slips remain held inwardly by the springs 73 around the mandrel, in released positions.

Figure 3:
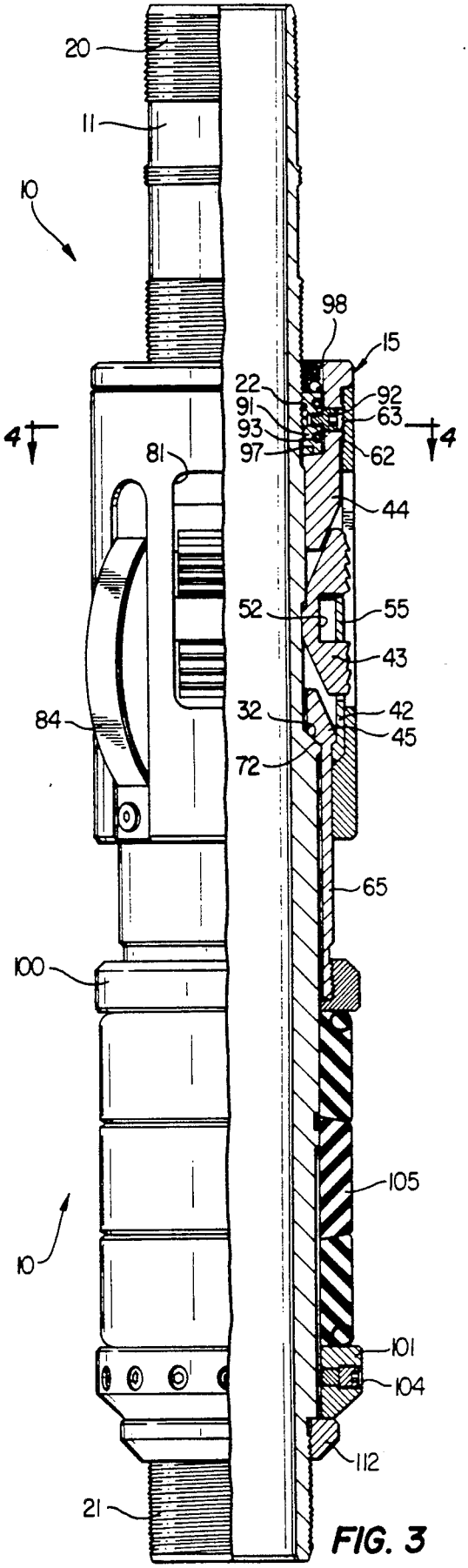
FIG. 3 is a longitudinal view in section and elevation of the well packer in an alternate pulling mode used under emergency conditions.

When releasing the packer, if the tubing string and mandrel cannot be rotated due to some binding or other problem, the tubing string and mandrel are pulled upwardly applying a shearing force to the pins 102, shearing the pins and releasing the bottom retainer 101 of the packer element assembly. The ring 101 will travel downwardly along the mandrel section 40 to the catcher ring 112. The housing 65 with the bottom wedge 45 will follow down on the mandrel until the shoulder 32 on the mandrel picks up the bottom wedge by engagement with the bottom wedge shoulder 72. The bottom wedge is pulled away from the lower ends of the slips and picks up the slip housing 42 by engagement of the wedge shoulder 71 with the housing shoulder 51 pulling the slips off of the top wedge 44. Also, the mandrel shoulder 26 will engage the internal shoulder 47 within the top wedge pulling the top wedge away from the upper ends of the slips 43. Thus, after the pins 102 are sheared, the continued pulling of the mandrel upwardly will space out the various components of the packer relaxing the packer element assembly 12 and retracting the slips 13 until the emergency release mode of the packer is obtained as illustrated in FIGS. 3. During this emergency pulling procedure, the interlock assembly 15 remains on the lower threads 24 of the mandrel. The packer then must be pulled from the well as it cannot be moved and reset. The packer is returned to the running mode of FIGS. 1 and the bottom retainer ring 101 resecured with the mandrel by new shear pins 102.

It will now will be seen that a new and improved well packer which is substantially shorter than prior art packers and can be run, set, released, and reset in a well bore has been described and illustrated. One particular area of novelty of this new packer is the use of the interlock assembly with the slip assembly associated with the drag spring and slip carrier assembly which includes the slip housing 42 as a movable member within the slip carrier 80. Such an arrangement provides a longitudinally compact assembly where the prior art required a separate drag spring and interlock assembly. A further area of novelty in the present packer is the employment of formed springs 73 in place of the more expensive and complex coil spring arrangements used with prior art slips to bias slips inwardly. Such new design features have reduced the length of the packer by approximately one half in comparison with prior art packers, and the cost has been reduced approximately sixty percent over prior art packers. Further, another area of novelty of the present packer resides in the unique design of the running segments and packer running threads as well as the locking segments and the bearing shoulders on the locking segments and in the looking and running segments retaining ring, as well as the ball plunger set screw assemblies. The running segments do not jam responsive to torque in the wrong direction applied to the tubing string interfering with packer setting and the locking segments maintain maximum engagement with the packer mandrel locking threads during setting and after setting under downward load.

What is claimed is:

1. A well packer comprising:

a tubular mandrel having a central longitudinal flow passage;

an annular packer element assembly on said mandrel for sealing around said mandrel with a well bore wall;

a drag spring and slip carrier assembly movably mounted on said mandrel;

a slip assembly in said drag spring and slip carrier assembly including a slip housing movable within and relative to said drag spring and slip carrier assembly;

an interlock assembly associated with said drag spring and slip carrier assembly for selectively coupling said mandrel with said slip assembly and said drag spring and slip carrier assembly to set and release said packer in a well bore, said interlock assembly including arcuate running segments for holding said packer in a release mode and arcuate locking segments for setting and releasing said packer in a well bore;

said running segments and said tubular mandrel having coacting means for limiting movement of said running segments away from said annular packing element assembly to release positions of said running segments on said mandrel at which slack remains in said drag spring and slip carrier assembly when torque is applied to said mandrel in a direction opposite to the direction of torque required for setting said packer; and means in said interlock assembly coacting with said locking segments for biasing lower end portions of said locking segments radially inwardly for maximum seating of said segments along said packer mandrel.

2. A well packer according to claim 1 wherein said mandrel has first threads formed in a first direction and second threads spaced from said first threads and formed in an opposite direction, said first threads coacting with said running segments when said packer is in a running mode and said second threads coacting with said locking segments for setting and locking said packer in a well bore.

3. A well packer according to claim 2 wherein said first threads are left-hand threads and said running segments have internal left-hand thread portions and said second threads are right-hand threads and said looking segments have internal right-hand thread portions.

4. A well packer according to claim 3 wherein said slip assembly includes locking slips mounted in windows in said slip housing and said slips with said slip housing are longitudinally movable within and relative to said slip carrier.

5. A well packer according to claim 4 where said drag spring and slip carrier assembly includes a tubular slip carrier having windows for said slips, said windows being longer than said slips to permit relative movement between said slip carrier and said slips and said slip housing during setting and releasing said packer.

6. A well packer according to claim 5 including an upper wedge for setting upper ends of said slips, said upper wedge being secured with said drag spring and slip carrier assembly for movement with said assembly relative to said slips.

7. A well packer according to claim 6 wherein said interlock assembly is positioned in an annular recess in an annular ring secured in an upper end of said slip carrier and integral with said upper wedge.

8. A well packer according to claim 7 including a lower wedge movable between said slip housing and said mandrel for expanding lower ends of said slips, said lower wedge including an integral tubular housing secured at a lower end thereof with an upper end of said packer element assembly.

9. A well packer according to claim 8 including an upper packer element retainer ring slidable on said mandrel at the upper end of said packer element assembly and secured on the lower end of said lower wedge housing.

10. A well packer according to claim 9 including a bottom retainer ring secured on said mandrel at the lower end of said packer element assembly and movable downwardly on said mandrel for emergency release of said packer, shear pins holding said bottom retainer ring against longitudinal movement on said mandrel, and a catcher ring secured on the lower end of said mandrel for holding said packer element assembly and said bottom wedge on said mandrel in an emergency release mode of said packer.

11. A well packer according to claim 10 including formed springs arranged in end-to-end array around said slips in said slip housing and latched on said slips for biasing said slips inwardly toward said mandrel.

12. A well packer according to claim 11 where each of said slips has a central outwardly opening transverse recess, upper and lower outer toothed portions above and below said recess, and a central connecting portion defining a bottom of said recess, and one of said formed springs extends across and is latched to each of said slips over said central connecting portion of said slip to hold said slip and bias said slip inwardly.

13. A well packer according to claim 12 where each said formed spring has straight opposite end portions extending outwardly at an angle in opposite directions when said spring is installed in said packer so that said end portions are compressed between said mandrel and an inner wall of said slip housing to urge the central portion of said spring inwardly, and each said spring has a central substantially rectangular three sided central portion between said end portions, said central portion being shaped to latch over and grip said central portion of said slip.

14. A well packer according to claim 3 where said first and said second threads on said mandrel and said thread portions in said running and said locking segments are buttress type threads oriented to permit said running segments to ratchet upwardly on said first threads on said mandrel and to permit said locking segment to rachet downwardly on said second threads on second mandrel, said threads in said running segments meshing with said first threads on said mandrel responsive to relative upward movement of said mandrel in said running segments, said threads in said locking segments meshing with said second threads on said mandrel in the set mode of said packer.

15. A well packer according to claim 14 where said running segments and said locking segments are held inwardly around said mandrel by garter spring means.

16. A well packer according to claim 15 where said running and said locking segments ar arranged in annular end-to-end array around said mandrel in said recess in said upper wedge and annular ring member and retaining screws are engaged through said ring into said locking segments, the head of each said screws being slidable in a radial recess of said ring to permit said segments to move inwardly and outwardly while being held against circumferential movement around said mandrel within said recess; said threads in said running segments extending from upper ends of said running segments only a portion of the internal length of said segments and an internal stop flange formed in said running segments spaced from said internal threads defining a release recess in said segments between said internal threads and said stop flange;

said running threads on said mandrel extending along said mandrel a distance less than the length said release recess in said running segments;

said recess in said upper wedge and annular ring member having a lower end surface sloping upwardly and outwardly forming a bearing shoulder in said member;

each of said locking segments having an upwardly and outwardly sloping lower end surface forming a bearing shoulder engageable with said bearing shoulder in said annular ring member recess; and a ball plunger set screw assembly in said annular ring member above each of said looking segments along the longitudinal axis of each of said locking segment radially outwardly of the centroid of each of said locking segments.

17. A well packer for sealing an annular space in a well bore around a well tubing comprising:

a longitudinal mandrel having a longitudinal central flow passage therethrough and threaded opposite end portions for connecting said mandrel with a tubing string, said mandrel being provided with first external running threads formed around said mandrel in a first direction along said mandrel a predetermined distance, second external locking threads spaced below said first threads formed around said mandrel in an opposite direction, a first external annular stop shoulder around said mandrel below said second threads for limiting relative downward movement on said mandrel of an upper wedge, a second external annular upwardly facing stop shoulder on said mandrel limiting downward movement on said mandrel of a bottom wedge, a third external annular downwardly facing stop shoulder on said mandrel limiting upward movement of an upper retainer ring of a packer element assembly, and a fourth downwardly facing external annular stop shoulder limiting upward movement of a bottom retainer ring of a packer element assembly;

a packer element assembly mounted on said mandrel below said third external annular stop shoulder for radial expansion around said mandrel to seal between said mandrel and a well bore wall;

an upper, stop ring mounted on said mandrel at the upper end of said packer element assembly below said third stop shoulder on said mandrel;

a bottom retainer ring mounted on said mandrel at the lower end of said packer element assembly and movable downwardly from said fourth annular stop shoulder on said mandrel;

shear pins releasably securing said bottom retainer ring to said mandrel for emergency release of said bottom retainer ring;

a catcher ring on said mandrel along said lower threaded end portion of said mandrel for holding said bottom retainer ring on said mandrel when said shear pins are sheared;

a drag spring and slip carrier assembly on said mandrel including a tubular slip carrier having circumferentially spaced longitudinal slip windows therein and an upper wedge and annular ring secured in the upper end of said slip carrier, said ring having an internal annular interlock assembly recess formed therein;

a bottom wedge having a tubular housing slidably positioned on said mandrel between said mandrel and said slip carrier, said housing being connected at a lower end with said top packer assembly retainer ring;

a tubular slip housing positioned within said slip carrier around said bottom wedge and bottom wedge housing, said slip housing having circumferentially spaced slip windows and a slip retainer housing section at the upper end of slip windows;

a plurality of circumferentially spaced, radially expandable and contractible, slips positioned within said slip housing and extendable through said slip housing windows and said slip carrier windows to engage a well bore wall around said packer for locking said packer with said well bore wall, each of said slips having upper and lower external toothed portions and a central recess, the bottom of said recess being defined by a connecting slip portion between said upper and lower slip portions, said central slip portion being retained by said retainer portion of said slip housing to prevent said slips from moving radially outwardly from said slip housing;

a plurality of circumferentially spaced formed springs disposed end-to-end array around said mandrel within said slip housing, each of said springs having opposite end portions compressible between said housing and said mandrel and a central portion engageable with said central portion of each of said slips for biasing said slips radially inwardly towards said mandrel;

an interlock assembly within said recess of said annular ring of said drag spring and slip carrier assembly, said interlock assembly including an upper wedge and interlock assembly retainer ring having an internal annular recess circumferentially spaced running segments and locking segments arranged in end-to-end array in said retainer ring recess, said running segments and said locking segments having internal thread portions formed in opposite directions, said thread portions in said running segments being engageable with said first threads on said mandrel and said thread portions in said locking segments being engageable with said second threads on said mandrel, said threads in said segments and on said mandrel being configured to permit said running segments to rachet along said first threads when said mandrel is moved downwardly relative to said running segments and to permit said locking segments to rachet upwardly relative to said second mandrel threads when said mandrel is moved relatively downwardly within said locking segments, said threads in said running segments meshing with first threads on said mandrel in the running mode of said packer and said threads within said locking segments meshing with said second threads on said mandrel in the locking mode of said packer;

said running threads on said mandrel extending along said mandrel a predetermined distance, said internal threads in said running segments extending from upper ends of said segments only a portion of the internal length of said segments, an internal stop flange across a lower inside portion of each of said running segments spaced from said threads in said segments defining an internal release recess in each of said segments between said threads in said segments and said internal stop flange, said release recess being longer than said running threads on said mandrel whereby upward movement of said running segments on said mandrel is limited to a release position of said running segments at which said running threads on said mandrel are in said release recess of said running segments whereby the movement of said running segments away from said packer element is limited, said running threads on said mandrel being positioned to limit the movement of said running segments to positions at which slack remains in said upper and lower wedges and slips and related parts;

said locking segments having upwardly and outwardly sloping lower end faces forming bearing shoulders on said locking segments, said annular recess in said retainer ring having an upwardly and outwardly sloping lower end face defining a bearing shoulder in said retainer ring engageable by said bearing shoulder on said locking segments for urging lower ends of said segments radially inwardly toward said mandrel responsive to downward forces on said segments, and ball plunger set screw assemblies secured in said retainer ring circumferentially spaced around said ring to position one of said set screw assemblies at an upper end of each of said locking segments, said set screw assemblies being aligned along a line parallel with a longitudinal axis of said locking segments radially outwardly from the centroid of each of said segments for urging said locking segments downwardly and applying a moment arm to each of said segments for urging said locking segments into full engagement with said locking threads on said mandrel;

garter spring means within said recess of said annular ring of said drag spring and slip carrier assembly around said running and locking segments of said interlock assembly to bias said segments inwardly around said mandrel, and screw means securing said segments with said annular ring to permit segments to move radially while holding said segments against circumferential movement around said mandrel within said recess; and circumferentially spaced longitudinally extending drag springs on said slip carrier for frictionally engaging a well bore wall around said slip carrier to restrain said slip carrier against longitudinal movement for setting and releasing said packer.

18. A well packer in accordance with claim 17 wherein said first running threads on said mandrel and said thread portions in said running segments are left-hand threads and said second locking threads on said mandrel and said threads in said locking segments are right-hand threads.

19. A well packer comprising:

a tubular mandrel having a central longitudinal flow passage;

an annular packer element assembly on said mandrel for sealing around said mandrel with a well bore wall;

a drag spring and slip carrier assembly movably mounted on said mandrel;

slip assembly in said drag spring and slip carrier assembly including a slip housing movable within and relative to said drag spring and slip carrier assembly;

an interlock assembly associated with said drag spring and slip carrier assembly for selectively coupling said mandrel with said slip assembly and said drag spring and slip carrier assembly to set and release said packer in a well bore, said interlock assembly including arcuate running segments for holding said packer in a release mode and arcuate locking segments for setting and releasing said packer in a well bore;

said running segments and said tubular mandrel having coacting means for limiting movement of said running segments away from said annular packing element assembly to a release position of said running segments on said mandrel at which slack remains in said drag spring and slip carrier assembly when torque is applied to said mandrel in a direction opposite to the direction of torque required for setting said packer;

means in said interlock assembly coacting with said locking segments for biasing lower end portions of said locking segments radially inwardly for seating said segments along said packer mandrel;

said interlock assembly further including an annular ring member having an internal annular recess therein, said running segments and said locking segments being arranged in annular end-to-end array in said ring member;

said tubular mandrel having external running threads and said running segments having internal threads engageable with said mandrel running threads, said internal threads in said running segments extending only a portion of the internal length of said segments and said segments including an internal annular stop shoulder spaced from said segment threads defining an internal release recess in each of said segments longer than said running threads on said mandrel whereby said running segments are moveable on said mandrel away from said annular packer element to release positions on said mandrel at which slack remains in said packer element assembly and said slip carrier assembly responsive to rotation of said tubular mandrel in a non-setting direction; and said tubular mandrel having locking threads spaced from said running threads formed in a direction opposite from said running threads, said locking segments having internal threads engageable with said locking threads on said mandrel, each of said locking segments having a lower end face sloping upwardly and outwardly defining a bearing shoulder on each of said locking segments, a lower end of said internal recess in said ring member recess sloping upwardly and outwardly defining a bearing shoulder in said annular ring member engageable by said bearing shoulder on said locking segments to urge said looking segments radially inwardly toward said locking threads, a plurality of ball plunger set screws mounted in said annular ring member at upper ends of said looking segments, one of said set screws being positioned above each of said locking segments along an axis parallel with longitudinal axis of said looking segment radially outward from the centroid of said segment to apply a downward force and bending moment on said locking segment to further urge said segment radially inwardly toward said looking threads on said tubular mandrel.

* * * * *